US007481086B2

(12) United States Patent
Fawcett et al.

(10) Patent No.: US 7,481,086 B2
(45) **Date of Patent: *Jan. 27, 2009**

(54) CABLE WRAP SECURITY DEVICE

(75) Inventors: Christopher J. Fawcett, Charlotte, NC (US); Ronald M. Marsilio, Lake Wiley, SC (US); Dennis D. Belden, Jr., Waxhaw, NC (US)

(73) Assignee: Checkpoint Systems, Inc., Thorofare, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/875,090

(22) Filed: Oct. 19, 2007

(65) Prior Publication Data

US 2008/0034815 A1 Feb. 14, 2008

Related U.S. Application Data

(63) Continuation of application No. 11/588,513, filed on Oct. 27, 2006, now Pat. No. 7,350,381, which is a continuation of application No. 11/023,721, filed on Dec. 28, 2004, now Pat. No. 7,162,899.

(51) Int. Cl.
*E05B 65/00* (2006.01)

(52) U.S. Cl. ..... 70/57; 70/49; 70/57.1; 242/382; 242/396.4

(58) Field of Classification Search ..... 70/18, 70/30, 49, 57, 57.1, 58, 233; 242/382, 382.5, 242/384.7, 388, 396.2, 396.4
See application file for complete search history.

(56) References Cited

U.S. PATENT DOCUMENTS 199,468 A * 1/1878 Rheutbottom ..... 70/49
343,849 A 6/1886 Pond
394,739 A 12/1888 Toulmin
437,548 A 9/1890 Anderson
499,832 A * 6/1893 Horne ..... 70/49
596,237 A 12/1897 Damon (Continued)

FOREIGN PATENT DOCUMENTS

DE 27 25 580 12/1977

(Continued)

*Primary Examiner*—Patricia L Engle
*Assistant Examiner*—Christopher Boswell
(74) *Attorney, Agent, or Firm*—Sand & Sebolt

(57) ABSTRACT

A security device includes a locking member, a ratchet mechanism, and a plurality of cables. The cables extend through both a fastener and a base of the locking member and are wrapped around all six sides of a box-like structure. The fastener is releasably snap-fitted into the base of the locking member and secured therein by a magnetically attractable tine. The ratchet mechanism includes a housing containing a spool and a locking pawl. A bottom wall encloses a portion of the housing and includes a rotatable central portion having a key receiving recess for unlocking the spool from the pawl. The housing has a rotatable top wall portion which includes a flip-up handle for rotating the top wall portion and the internal ratchet to tighten the cable about an article. An alarm system is contained in the housing of the ratchet mechanism and actuates an audible alarm upon certain unauthorized actions occurring. An LED located within the housing provides a visual indication that the alarm system is activated.

20 Claims, 9 Drawing Sheets

U.S. PATENT DOCUMENTS

| | | | | | |
|---|---|---|---|---|---|
| 639,196 | A | | 12/1899 | Fehling | |
| 673,612 | A | | 5/1901 | Appleby | |
| 886,905 | A | | 5/1908 | Ward | |
| 895,403 | A | | 8/1908 | Jackson | |
| 1,083,612 | A | | 1/1914 | Hooker | |
| 1,124,130 | A | | 1/1915 | Grant | |
| 1,141,245 | A | | 6/1915 | Gillespie | |
| 1,165,320 | A | | 12/1915 | Clary | |
| 1,165,816 | A | | 12/1915 | Tichenor | |
| 1,657,190 | A | | 1/1928 | Ballou | |
| 1,992,868 | A | | 2/1935 | Krause | |
| 2,002,946 | A | | 5/1935 | Jacobs | |
| 2,574,967 | A | * | 11/1951 | Gossner et al. | 70/49 |
| 3,395,555 | A | | 8/1968 | Hickman | |
| 3,397,849 | A | | 8/1968 | Hansen | |
| 3,466,668 | A | | 9/1969 | Ochiai | |
| 3,568,902 | A | | 3/1971 | Highberger | |
| 3,611,760 | A | | 10/1971 | Muther | |
| 3,831,407 | A | | 8/1974 | Coleman | |
| 3,906,758 | A | | 9/1975 | Hurwitt | |
| 3,929,300 | A | | 12/1975 | Lindqvist | |
| 4,004,440 | A | | 1/1977 | Dreyer | |
| 4,071,023 | A | | 1/1978 | Gregory | |
| 4,086,795 | A | | 5/1978 | Foster et al. | |
| 4,418,551 | A | | 12/1983 | Kochackis | |
| 4,665,724 | A | * | 5/1987 | Sakai | 70/30 |
| 4,756,171 | A | | 7/1988 | Homar | |
| 4,896,517 | A | | 1/1990 | Ling | |
| 4,930,324 | A | | 6/1990 | Meier | |
| 4,949,679 | A | | 8/1990 | Wolfer | |
| 5,144,821 | A | | 9/1992 | Ernesti et al. | |
| 5,156,028 | A | | 10/1992 | Jiang | |
| 5,193,368 | A | | 3/1993 | Ling | |
| 5,345,947 | A | | 9/1994 | Fisher | |
| 5,379,496 | A | | 1/1995 | Krauss | |
| 5,517,836 | A | | 5/1996 | Hong | |
| 5,551,447 | A | | 9/1996 | Hoffman et al. | |
| 5,581,853 | A | | 12/1996 | Miller et al. | |
| 5,598,727 | A | | 2/1997 | White | |
| 5,610,587 | A | | 3/1997 | Fujiuchi et al. | |
| 5,671,506 | A | | 9/1997 | Eliasson | |
| 5,687,455 | A | | 11/1997 | Alexander | |
| 5,687,456 | A | | 11/1997 | Chang | |
| 5,722,266 | A | | 3/1998 | Yeager et al. | |
| 5,794,464 | A | | 8/1998 | Yeager et al. | |
| 5,832,752 | A | * | 11/1998 | Zeller | 70/30 |
| 5,856,782 | A | | 1/1999 | Sasagawa et al. | |
| 5,960,652 | A | | 10/1999 | Marmstad | |
| 6,040,764 | A | * | 3/2000 | Crisci | 70/57.1 |
| 6,092,401 | A | | 7/2000 | Sankey et al. | |
| 6,128,932 | A | | 10/2000 | Mainetti et al. | |
| 6,237,375 | B1 | | 5/2001 | Wymer | |
| 6,550,293 | B1 | | 4/2003 | Delegato et al. | |
| 6,681,603 | B1 | * | 1/2004 | Yu | 70/18 |
| 6,755,055 | B2 | | 6/2004 | Sedon et al. | |
| 7,162,899 | B2 | | 1/2007 | Fawcett et al. | |
| 7,168,275 | B2 | | 1/2007 | Fawcett et al. | |
| 7,221,274 | B2 | * | 5/2007 | Fawcett et al. | 70/57.1 |
| 7,251,966 | B2 | * | 8/2007 | Fawcett et al. | 70/57 |
| 7,272,962 | B2 | * | 9/2007 | Benda et al. | 70/18 |
| 2003/0182763 | A1 | | 10/2003 | Jeffries | |

FOREIGN PATENT DOCUMENTS

| | | | | |
|---|---|---|---|---|
| DE | 3543201 | A1 | * | 6/1987 |
| EP | 0 620 381 | A1 | | 10/1994 |
| SE | 123470 | | | 11/1948 |
| WO | WO 2006/040693 | | | 4/2006 |

* cited by examiner

CABLE WRAP SECURITY DEVICE

CROSS REFERENCE TO RELATED APPLICATION

This application is a continuation of U.S. patent application Ser. No. 11/588,513, filed Oct. 27, 2006, which is a continuation of U.S. patent application Ser. No. 11/023,721, filed Dec. 28, 2004; the disclosures of which are incorporated herein by reference.

BACKGROUND OF THE INVENTION

1. Technical Field

The invention relates to a security device, and more particularly to an adjustable security device which wraps around and secures a box-like structure in a secure locked position. Even more particularly, the invention relates to such a cable security device which includes a plurality of wires or cable that wrap around the article to be protected and has an unique ratchet mechanism for tightening the cable around the article of merchandise and a quick release locking mechanism, and which has an attached key for unlatching the ratchet mechanism.

2. Background Information

Retail stores have a difficult time protecting boxes containing various expensive merchandise, books and other similarly structured packages, or protecting such containers from being opened and the contents thereof being removed without authorization from store personnel or damaged while on display. Consumers often want to visually inspect the packaged expensive articles before deciding to purchase them. The store is faced with the problem of how to protect these expensive articles from theft while displaying them for sale.

One method used to protect these packages and the articles contained therein is to enclose the article within a transparent glass display case which can only be accessed from behind a counter of the retail store. The consumer can view the article through the glass but is not able to handle the article or read any of the information about the article that may be printed on the box unless a store clerk removes the article from the case. However, in large retail stores, the problem then arises of getting the selected merchandise to the customer after the customer wishes to purchase the same without subjecting the merchandise to theft. One manner is to maintain a supply of the boxes containing the expensive articles or merchandise close at hand for delivery to or pick-up by the customer for subsequent taking to a check-out clerk. However this makes the boxes susceptible to theft and requires additional sales personnel.

Another method used by retail stores is to list the article in a catalog and require consumers to place an order from the catalog. The article is delivered from a back storage area and the consumer must simultaneously pick up and pay for the merchandise at the same location to prevent unauthorized removal from the store. The consumer does not get to inspect the article before purchasing and if they are not satisfied they must undergo the hassle of returning the article for a refund.

Boxes and box-like structures are also subjected to unauthorized openings while being shipped via a courier. These articles can be easily opened and resealed when packaged and taped-shut in the conventional manner without the recipient or the sender knowing of such actions. Shipped packages can be secured within a security container with a locking mechanism but these containers are expensive to purchase and add size and weight to the package making it more expensive to ship. Also, would-be thieves can gain unauthorized access to the contents of these containers by "picking" the locking mechanisms or possibly guessing the combination to a combination lock.

Few prior art locking devices have adequately solved this problem of securing packages or objects in a closed condition while being displayed in retail stores or shipped from one location to another. Some prior art security devices include a wire which wraps around an article and is secured by some type of locking mechanism. For example, see U.S. Pat. Nos. 3,611,760, 4,418,551, 4,756,171, 4,896,517, 4,930,324, 5,156,028, 5,794,464, and 6,092,401.

The particular security device shown in U.S. Pat. No. 5,794,464 has proven satisfactory, but requires a special tool to operate the latch mechanism, both for tightening the cable about the object to be protected and to release the latch mechanism after the security device has been removed from the package to enable the internal mechanism on which the cable is wound to be free-wheeling in order to be pulled outwardly to a larger size for placement around another package. This separate and specially designed key becomes a problem in that it can become lost or stolen and must always be associated with and manipulated for operating the security device.

Furthermore, the ratchet mechanism of U.S. Pat. No. 5,794,464 as well as the other known cable wrap ratchet-actuated security devices can be defeated by excessive force or manipulation of the ratchet device and/or of the package being protected, which could go undetected by the store personnel.

Therefore, the need exists for a cable wrap security device which includes a ratchet member and a locking member which does not require any special tool to tighten the cable about a package, in which part of the lock mechanism forms the tool for unlatching the ratchet mechanism to provide for the free-wheeling of the internal spool thereof, and in which the ratchet member can be provided with an internal audible alarm which will be actuated if the integrity of the security device is compromised or the protected article stolen from the retail store.

BRIEF SUMMARY OF THE INVENTION

The security device of the present invention includes a plurality of wires or cables which encircle and lock all six sides of a box, package, book or other similar structure. The cable extends between a ratchet member which includes a gear with a plurality of teeth, a one-way pawl which engages the teeth, and a locking member which includes a fastener which snap-fits to a base and requires a special unlocking tool or key to unlock.

Another feature of the present invention is to provide such a security device which requires only a special magnetic key to unlock the locking member to enable the cable to be removed from the protected device.

A further feature of the present invention is to provide the device with an audible alarm which is actuated should the integrity of a sensing loop in the securing cable be jeopardized or compromised, and in which the security device contains an EAS tag which actuates an alarm at a security gate should a potential thief attempt to leave the premise before removing the cable wrap security device from the protected article.

A still further feature of the invention is to provide such a security device which includes a one-way ratchet which can be released by a key formation formed on the locking mechanism thereby eliminating the need for a separate key to release the latching mechanism as heretofore required.

Another feature of the invention is to provide such a security device in which the locking mechanism is open by a specially designed magnetic release mechanism.

Still another aspect of the invention is to provide such a security device in which the ratchet mechanism is actuated to tighten the cable about an article by a flip-up handle on the ratchet mechanism avoiding the need for a special key to rotate the ratchet mechanism and tighten the cable about the protected article.

These features are obtained by the security device of the present invention, the general nature of which may be stated as comprising a cable for placement about an object to be secured; a ratchet mechanism connected to the cable having a flip-up handle moveable between a raised operating position for manual rotation for tightening the cable around the object and a down position conforming generally to the contour of the ratchet mechanism; and a two-piece locking member including a base and a fastener which are connected to the cable and releasable locked together for releasable locking said cable about the object.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
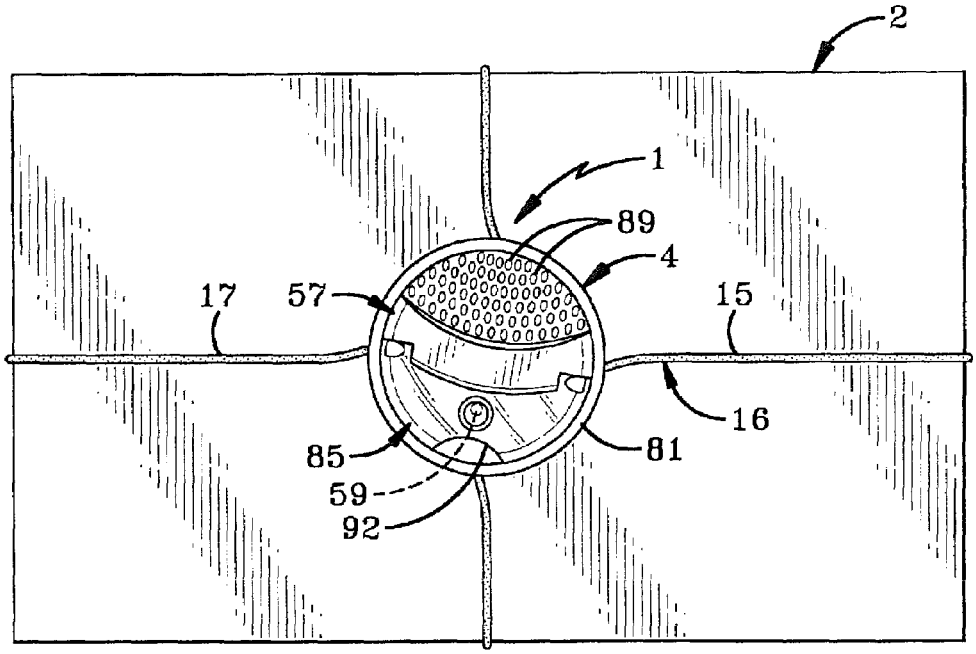
FIG. 1 is a diagrammatic plan view showing the security device of the present invention secured on a package.
Figure 2:
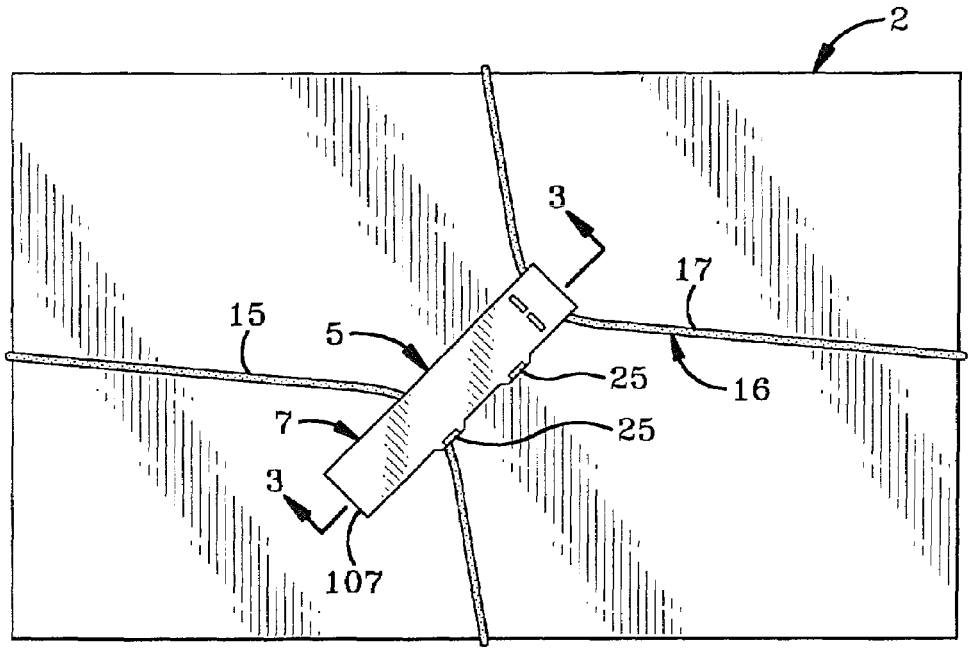
FIG. 2 is a view similar to FIG. 1 showing the locking member of the security device located on the opposite side of the package from that of the ratchet mechanism shown in FIG. 1.

The security device of the present invention is indicated generally at 1, and is shown in FIGS. 1 and 2 secured about a package 2. Security device 1 includes two main components, a ratchet mechanism and a locking member indicated generally at 4 and 5, respectively.

Figure 3:
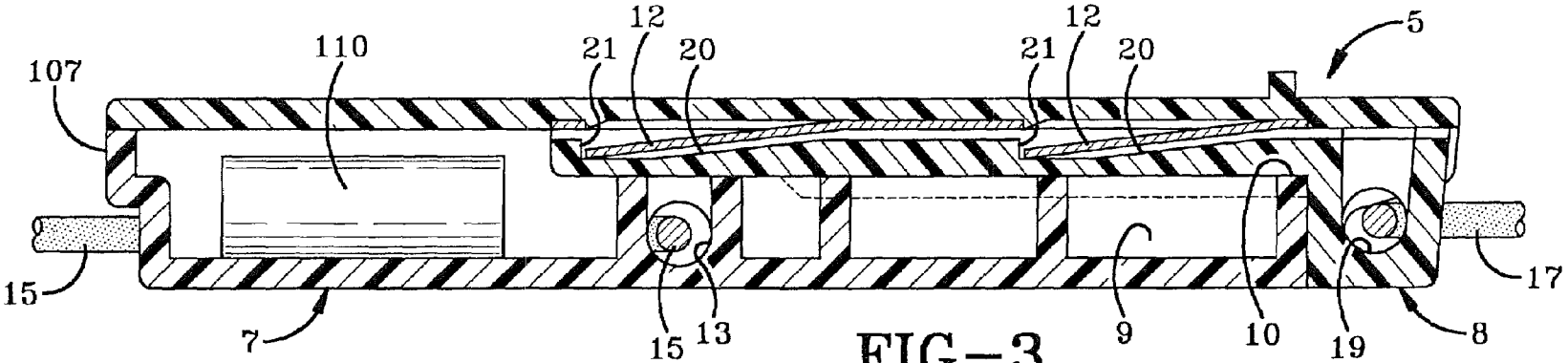
FIG. 3 is an enlarged sectional view taken on line 3-3, FIG. 2 showing the locking member in a locked position.
Figure 4:
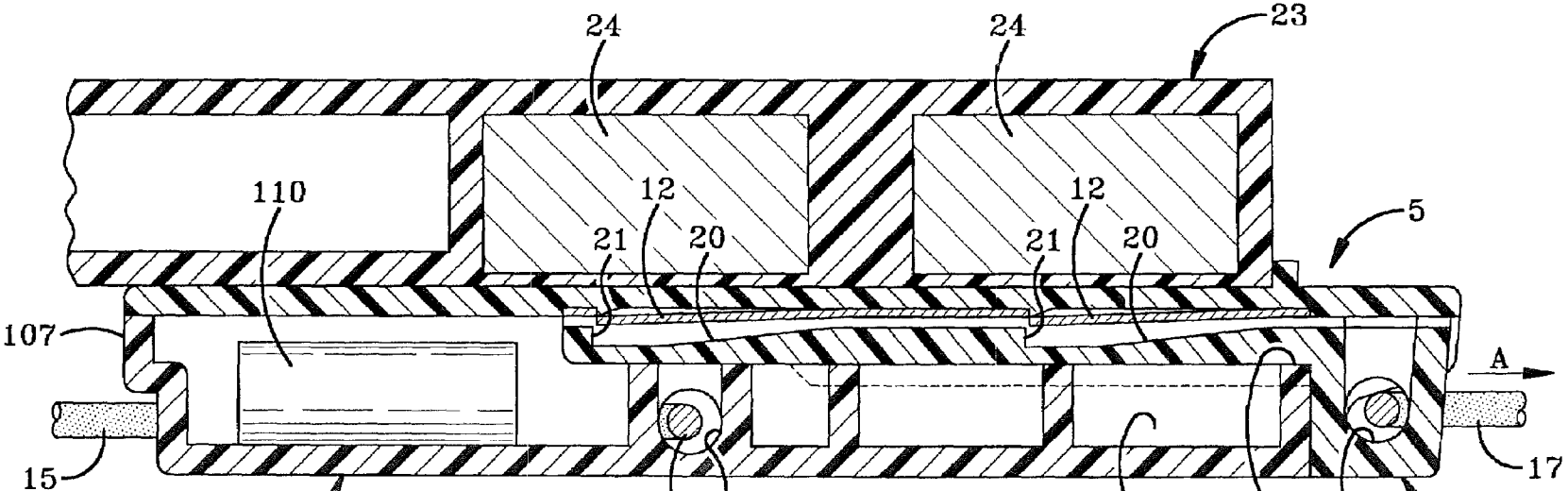
FIG. 4 is a view similar to FIG. 3 showing a magnetic key unlocking the locking member.
Figure 5:
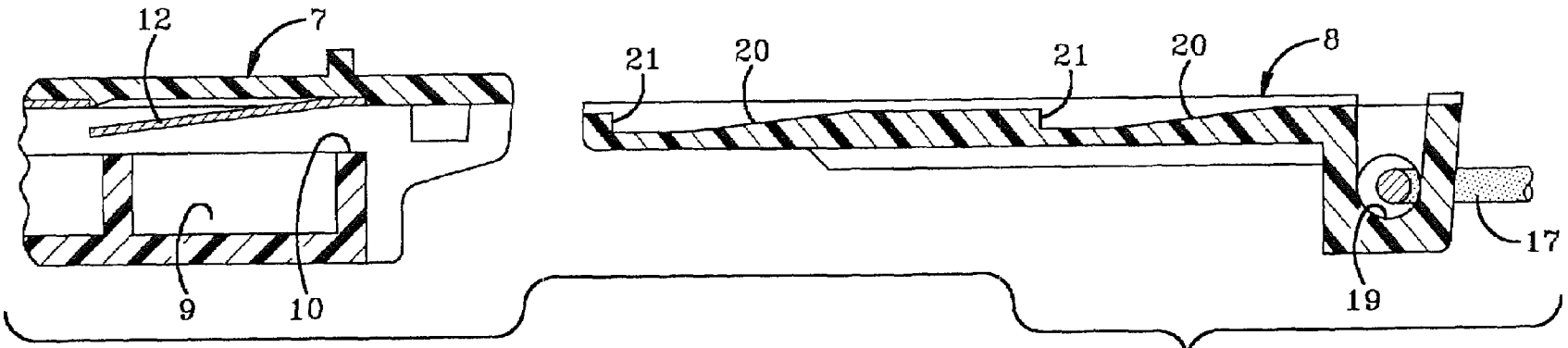
FIG. 5 is a sectional view showing the two-piece locking member in a disengaged unlocked position.
Figure 6:
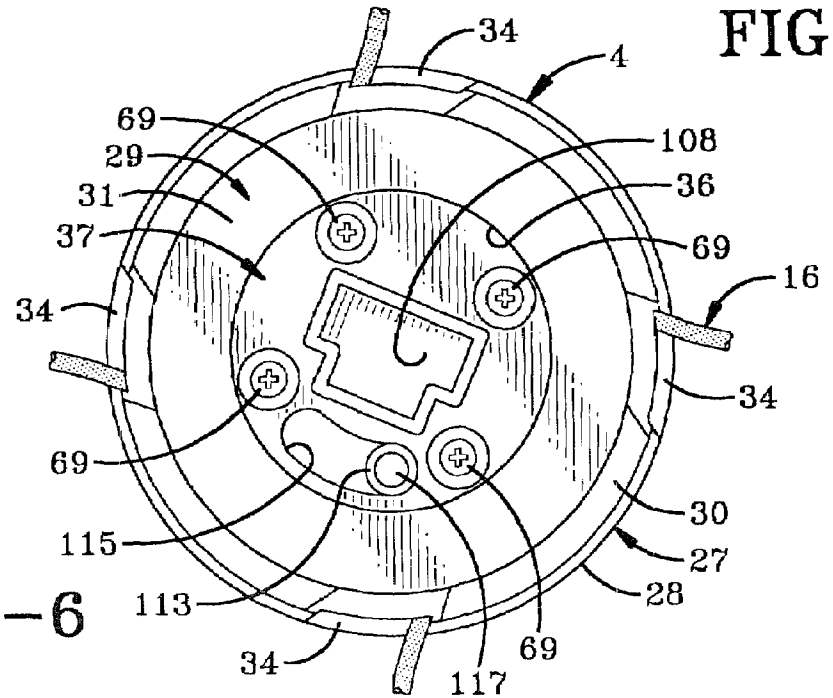
FIG. 6 is a bottom plan view of the ratchet mechanism of FIG. 1 with a fragmentary portion of the securing cables shown extending outwardly therefrom.

Locking member 5 shown particularly in FIGS. 3-5, is a two-piece member consisting of a base 7 and a fastener 8. Base 7 preferably is an elongated member formed of rigid plastic having an internal chamber 9 and an entrance opening 10. A pair of metal tines 12 are mounted within chamber 9 and are biased inwardly as shown particularly in FIG. 3. Base 7 is formed with a through opening 13 through which extends a first cable loop 15, which is one portion of the securing cable collectively indicated at 16.

Fastener 8 is an elongated member preferably formed of rigid plastic, and has another cable loop 17 extending through an opening 19 formed in one end of the fastener. Fastener 8 is formed with a pair of angled recesses 20 which terminate in shoulders 21 which are engaged by the distal ends of metal tines 12 when fastener 8 is inserted into base 7 as shown in FIG. 3, to secure fastener 8 in a locked position within base 7. Fastener 8 cannot be withdrawn toward the unlocking position as shown in FIG. 5, due to the engagement of the distal ends of metal tines 12 with shoulders 21. However, locking member 5 is opened easily by a clerk at the checkout counter of a retail store by placement of a magnetic key 23 in a controlled position on base 7. Key 23 contains a pair of magnets 24 and are positioned to align with a respective metal tine 12 to move the metal tines out of locking engagement with its respective shoulder 21. This enables fastener 8 to be moved in the direction of Arrow A (FIG. 4) to disengage from base 7 as shown in FIG. 5.

Locking member 5 preferably includes a pair of alignment projections 25 (FIG. 2) which align with projections on key 23 to ensure that magnetic key 23 is properly placed on member 5 so that magnets 24 accurately align with their respective metal tines 12 to move the tines to the unlocked position. This specially positioned pair of magnets 24 in relationship to the spaced tines 12, reduces the possibility of a shoplifter unlocking locking member 5 by use of a single unauthorized magnet.

Ratchet mechanism 4 (FIGS. 7-13) includes a housing 27 which has a cylindrical side wall 28 and a stepped bottom wall 29. Bottom wall 29 (FIG. 9) has a first raised cylindrical surface 30 and a lower concentric cylindrical surface 31, with a plurality of one-way gear teeth 32 being formed on a connecting surface extending between surfaces 30 and 31 and extending circumferentially thereabout. Four openings 34 are formed in side wall 28 and upper cylindrical surface 30 for the passage of securing cable 16 therethrough as discussed further below. A large circular central opening 36 is formed in bottom wall 29 for receiving a pawl release plate 37 therein. Housing 27 preferably is a one-piece member formed of a rugged plastic material.

Ratchet mechanism 4 further includes a spool indicated generally at 40 (FIGS. 12 and 13), which includes a central hub 41 and first and second spaced flanges 42 and 43 extending outwardly therefrom and spaced from each other for capturing cable 16 therebetween when the cable loops 15 and 17 are tightened about package 2. Spool 40 preferably is a one-piece member molded of a rigid plastic material and cable 16 preferably is comprised of the two cable sections or loops 15 and 17. A circular central recess 45 (FIG. 9) is formed in flange 43 and contains a printed circuit board 46 which includes the necessary electronic circuitry (not shown) well-known in the art, for providing an alarm system discussed further below. Four slotted holes 48 are formed in flange 43 and communicate with cable openings 34 for inserting enlarged ends 49 of cable loops 15 and 17 therethrough. Ends 49 are metallic and are received within small compartments 51 formed on circuit board 46, where they are connected to the electric circuitry of circuit board 46 by conductors 52. Three of the four cable enlarged ends 49 are shown seated within their respective compartments 51 and are connected to circuit board 46 by conductors 52.

The alarm system further includes an audible alarm having a speaker 54 (FIG. 9) which is mounted within a complimentary shaped circular recess 55 formed on the inside surface of a top wall portion 57, which is another of the main components of ratchet mechanism 4. Speaker 54 is connected to circuit board 46 by a pair of conductors 58. The alarm system further includes a LED 59 which aligns with a hole 60 formed in top wall portion 57. LED 59 is connected in the alarm circuitry and preferably provides a blinking action which indicates that the alarm system is operating serving as a deterrent to a possible shoplifter.

Figure 14:
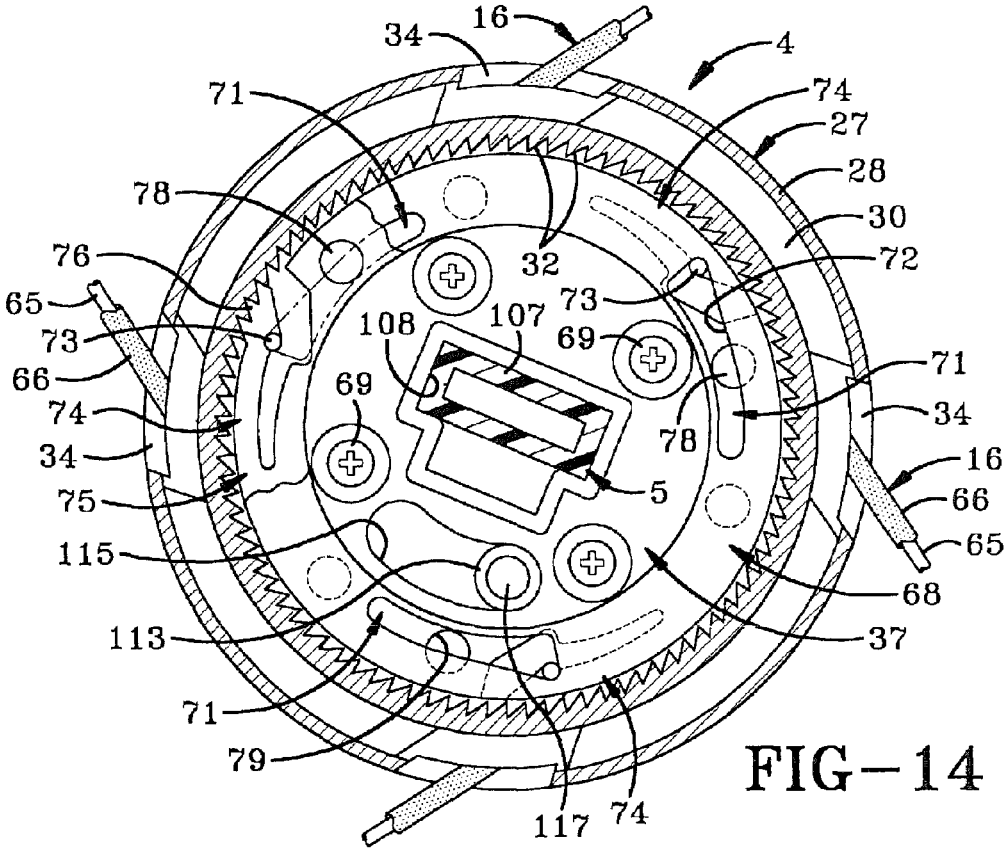
FIG. 14 is a bottom plan view of the ratchet mechanism with portions broken away and in section, showing the end of the locking member base engaged with the pawl release bottom plate of the ratchet mechanism.
Figure 15:
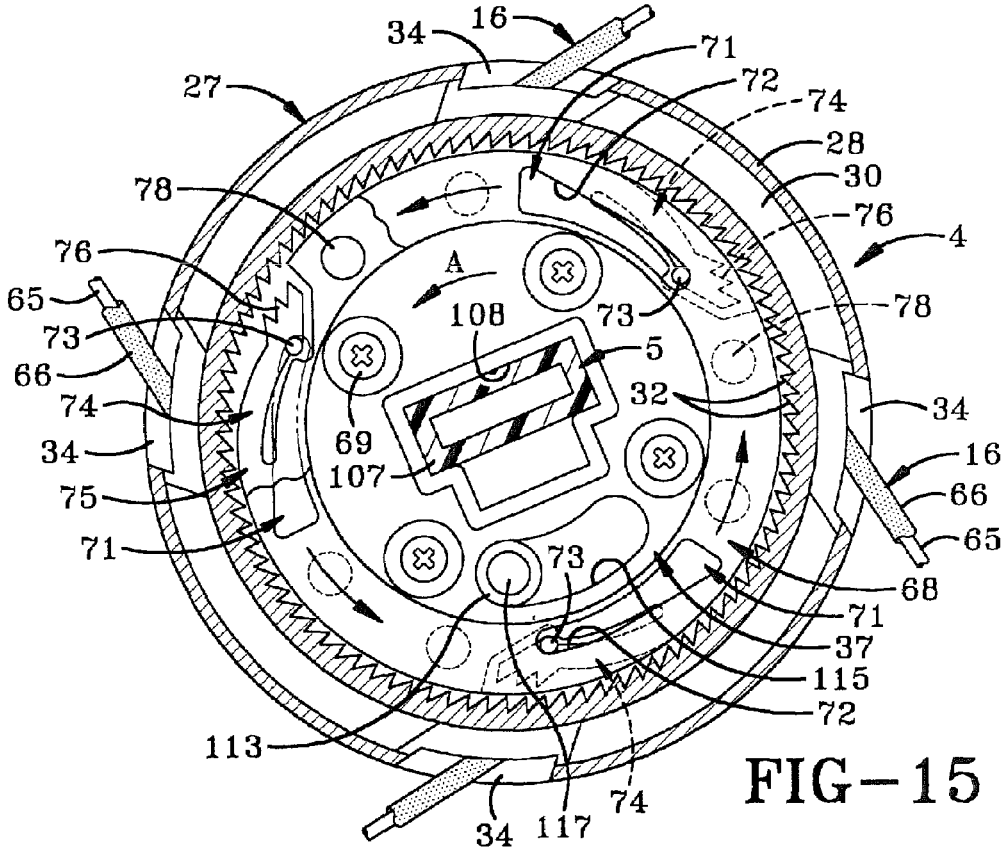
FIG. 15 is a view similar to FIG. 14 showing the bottom plate of the ratchet mechanism moving the locking pawls of the gear disc out of engagement with the gear teeth of the gear housing to place the cable spool in a free wheeling position.

In further accordance with the invention, the alarm system includes a sense loop which extends through the cable loops 15 and 17 by the electrical connection of enlarged ends 49 with circuit board 46 through conductors 52. The alarm system sends a series of pulses or maintains a constant flow of electrical energy through the cables by power supplied by a battery 62 (FIG. 12) which is located within a complimentary shaped recess 63 formed within the central opening of flange 42. Battery 62 is connected to the circuitry of circuit board 46 by a metallic connector 64. Thus, the alarm system contained within ratchet mechanism 4, provides a continuous sensing loop extending through the cables, which as shown in FIGS. 14 and 15, will include an inner metallic conductor 65 covered by a layer of insulation 66. Cable loops 15 and 17 provide the necessary mechanical strength for securing security device 1 about package 2, as well as the electrical circuitry to provide a sensing loop, which if compromised in any manner, such as cutting through one of the cable conductors 65 or pulling it loose from its connection to the printed circuit board, will actuate the audible alarm alerting store personnel of the unauthorized tampering of security device 1.

Figure 12:
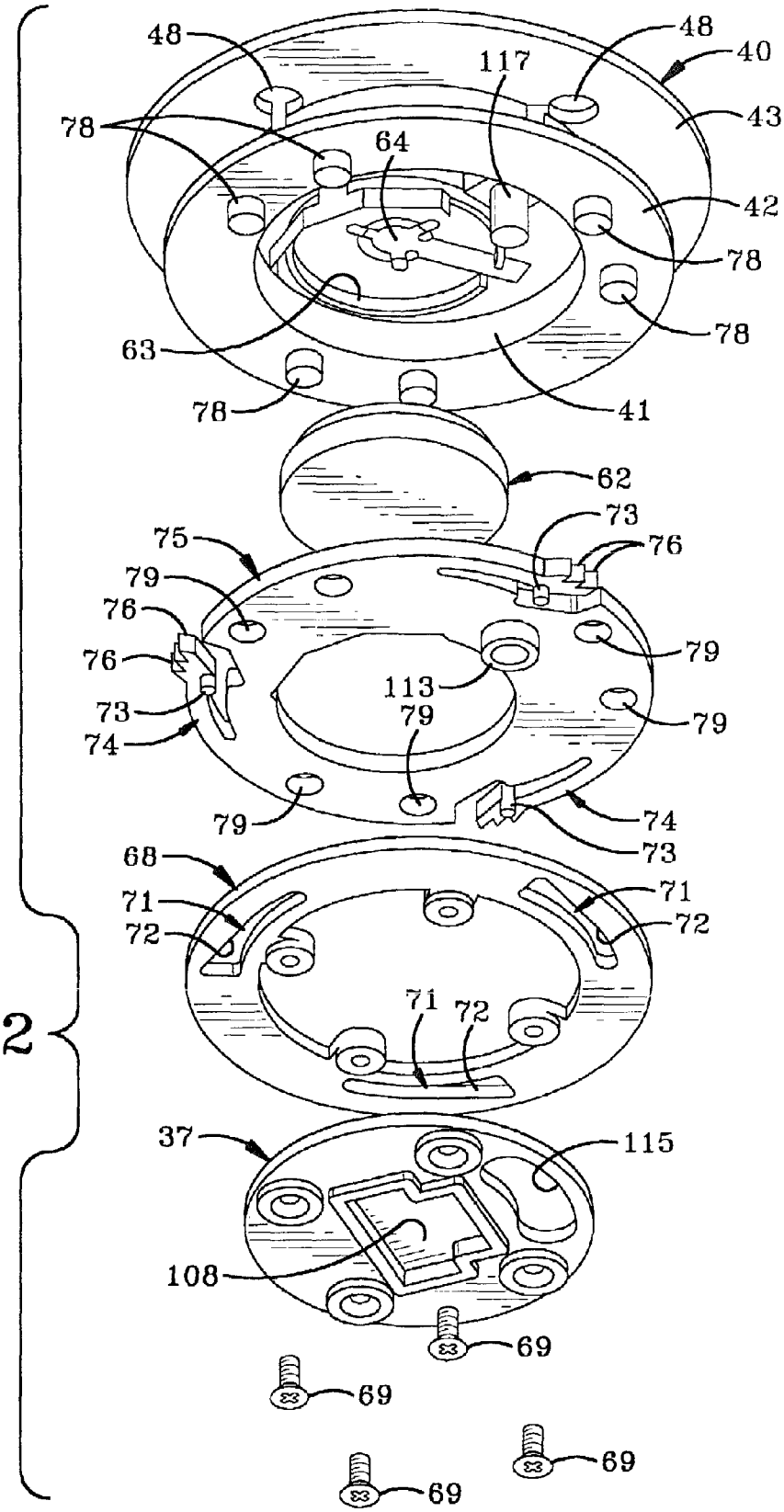
FIG. 12 is an exploded perspective view of various components of the ratchet mechanism.

Ratchet mechanism 4 further includes a locking disc indicated generally at 68 (FIG. 12), which is secured to pawl release plate 37 by a plurality of screws 69 so as to rotate with plate 37. Locking disc 68 is formed with a plurality of actuate camming slots 71 (FIG. 11) spaced equally circumferentially about disc 68, in which are received a respective camming projection 73 formed on a locking pawl 74, three of which are formed on a gear disc indicated generally at 75 (FIG. 12). Each locking pawl 74 includes one or more locking teeth 76 formed on the distal end of the lever-like arm which forms locking pawl 74. Gear disc 75 is mounted on flange 42 of spool 40 by a plurality of projections or circular tabs 78, six of which are shown in the drawing, which extend through aligned holes 79 formed in gear disc 75, whereby gear disc 75 is rotatable with spool 40. Gear disc 75 is operatively connected to locking disc 68 only through the engagement of camming projections 73 extending into camming slots 71 as discussed further below.

Top wall portion 57 of ratchet mechanism 4 is rotatable mounted within a top opening of housing 27 by a lock ring 81 (FIGS. 7 and 8), which preferably is attached to housing side wall 28 by a sonic weld, an adhesive, etc. Three bosses 83 (FIG. 9) are formed on and extend outwardly from the bottom surface of top wall portion 57 and extend through aligned holes 48 formed in spool flange 43 to operationally connect top wall portion 57 with spool 40, whereby rotation of top wall portion 57 will rotate spool 40 therewith.

Figure 7:
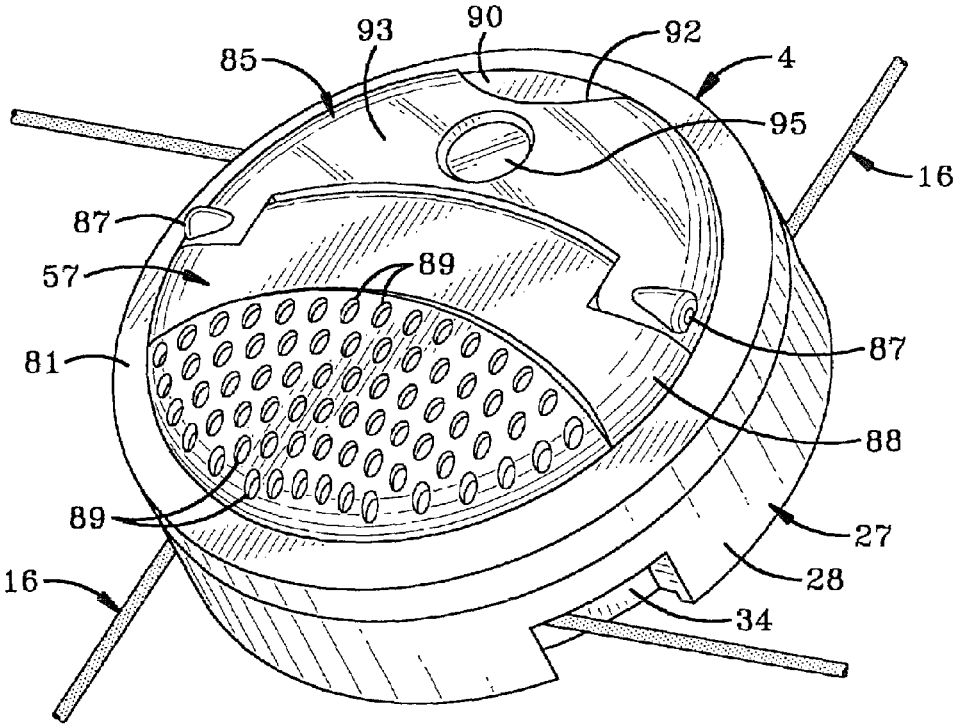
FIG. 7 is a top perspective view of the ratchet mechanism with the flip-up handle in a down inoperative position.
Figure 8:
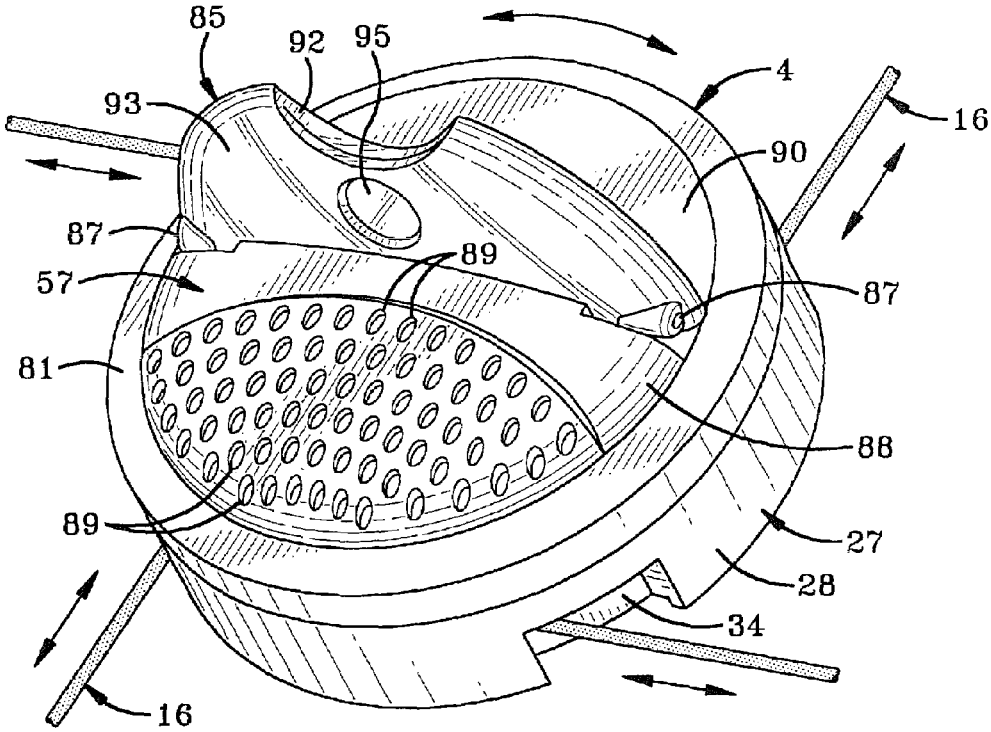
FIG. 8 is a view similar to FIG. 7 with the flip-up handle in a raised operating position.
Figure 9:
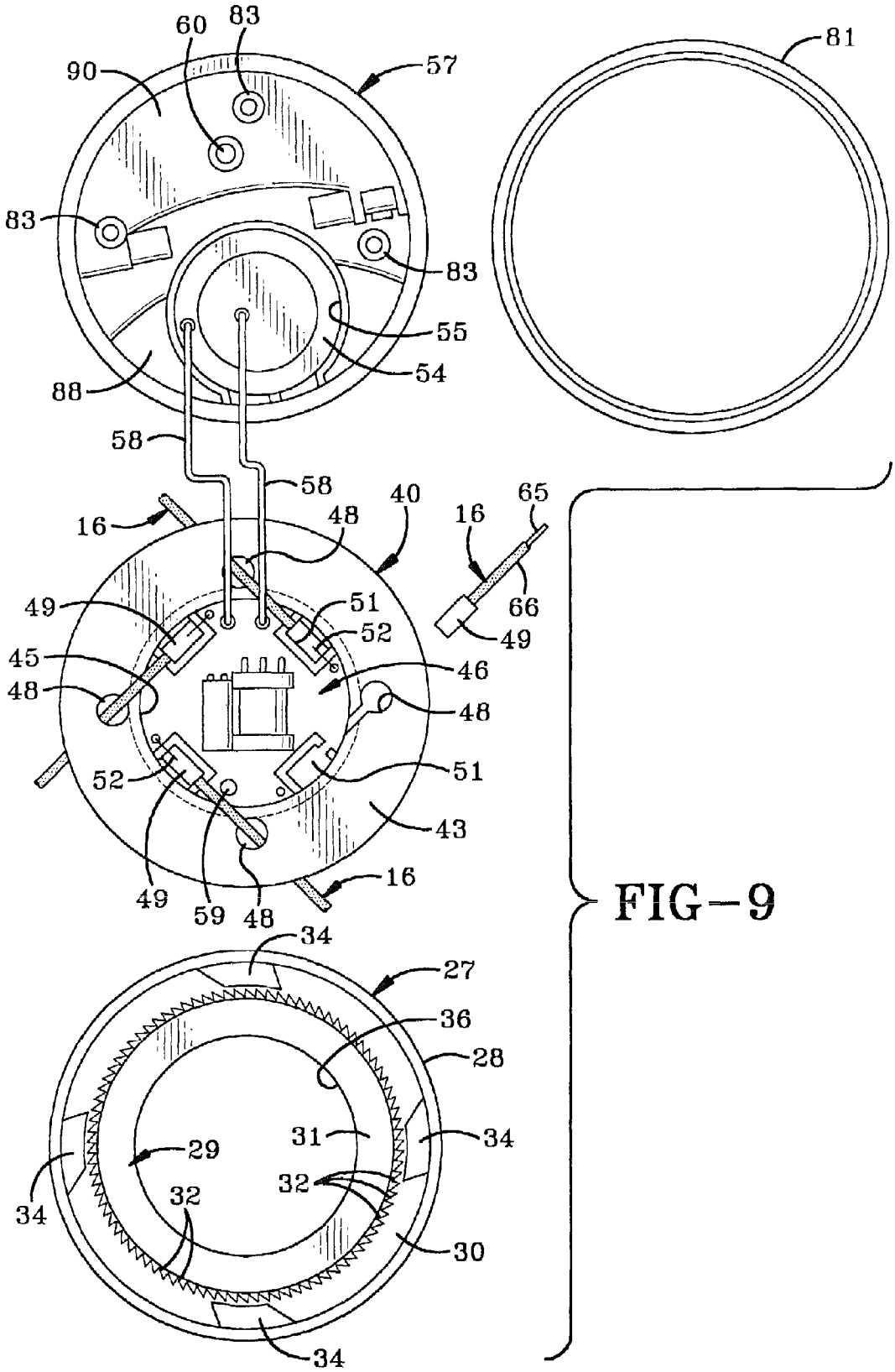
FIG. 9 is an exploded view of portions of the housing, cable spool, top wall cover plate, gear housing and lock ring of the ratchet mechanism.
Figure 10:
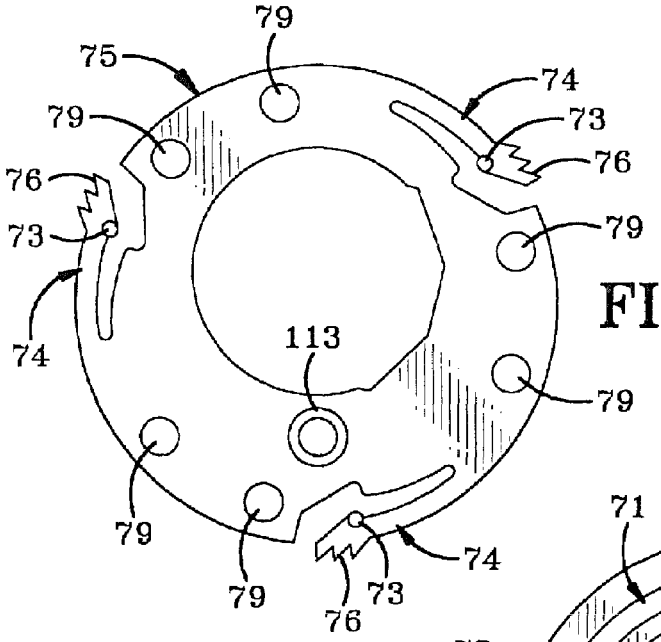
FIG. 10 is a bottom plan view of the gear disc removed from the ratchet mechanism spool.
Figure 11:
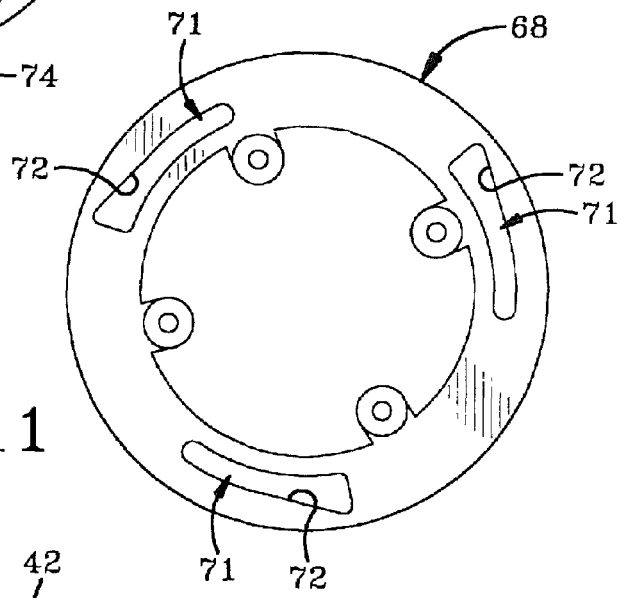
FIG. 11 is a bottom plan view of the locking disc removed from the ratchet mechanism spool.
Figure 13:
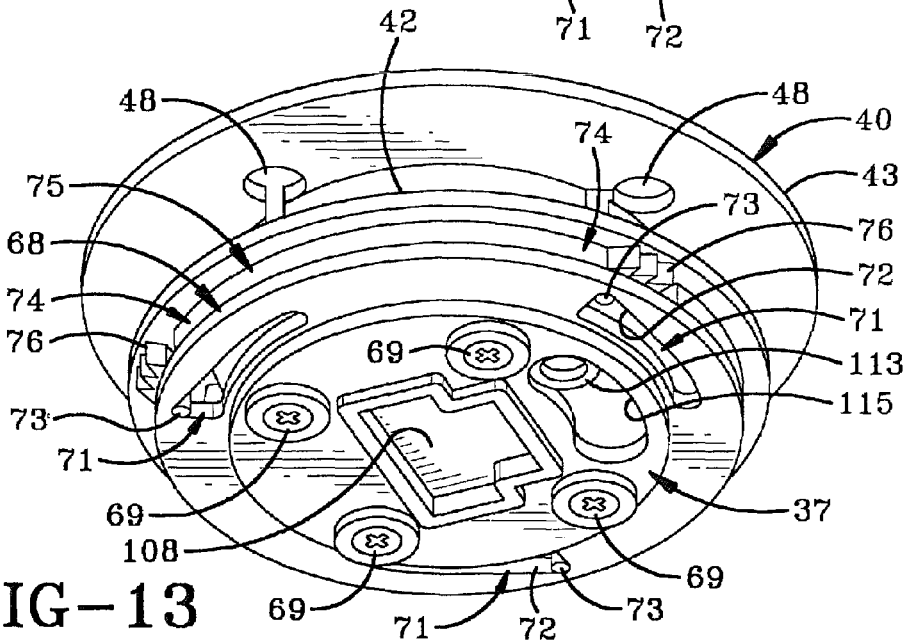
FIG. 13 is an assembled view of the ratchet mechanism components shown in FIG. 12.

In accordance with one of the features of the present invention, a flip-up handle indicated generally at 85, is mounted on top wall portion 57 and is moved from a down generally inoperative position as shown in FIG. 7, to a raised operative position as shown in FIG. 8. Handle 85 is pivotally mounted by a pair of pivot pins 87 to a half dome-shaped portion 88 of top wall portion 57. A plurality of perforations or holes 89 preferably are formed in dome-shaped portion 88 and align with the audible alarm speaker 54 mounted adjacent thereto as shown in FIG. 9. A generally planar semicircular portion 90 forms the other half of top wall portion 57 and receives the flip-up handle 85 when the handle is in the down position as shown in FIG. 7. Handle 45 preferably is formed with a concave finger grasping area 92 so that a user can easily grasp the flip-up handle for moving it between the down position of FIG. 7 to the operable position of FIG. 8. Handle 85 preferably has a smooth curved top surface 93, having a curvature generally matching that of half dome-shaped portion 88, to provide for a smooth attractive appearance to the ratchet mechanism so that it does not distract appreciably from a merchandise display box when secured thereon.

In accordance with another feature of the invention, flip-up handle 85 may be formed of a transparent material and will have a circular lens 95 in the center thereof which aligns with LED 59 when in the down position of FIG. 7. This will help distribute the light of the LED throughout the length of the handle, making it more visible to a perspective shoplifter and to indicate to the store personnel that the alarm system is activated. This translucent or clear plastic construction of handle 85 further increases the esthetics of the ratchet mechanism.

Figure 16:
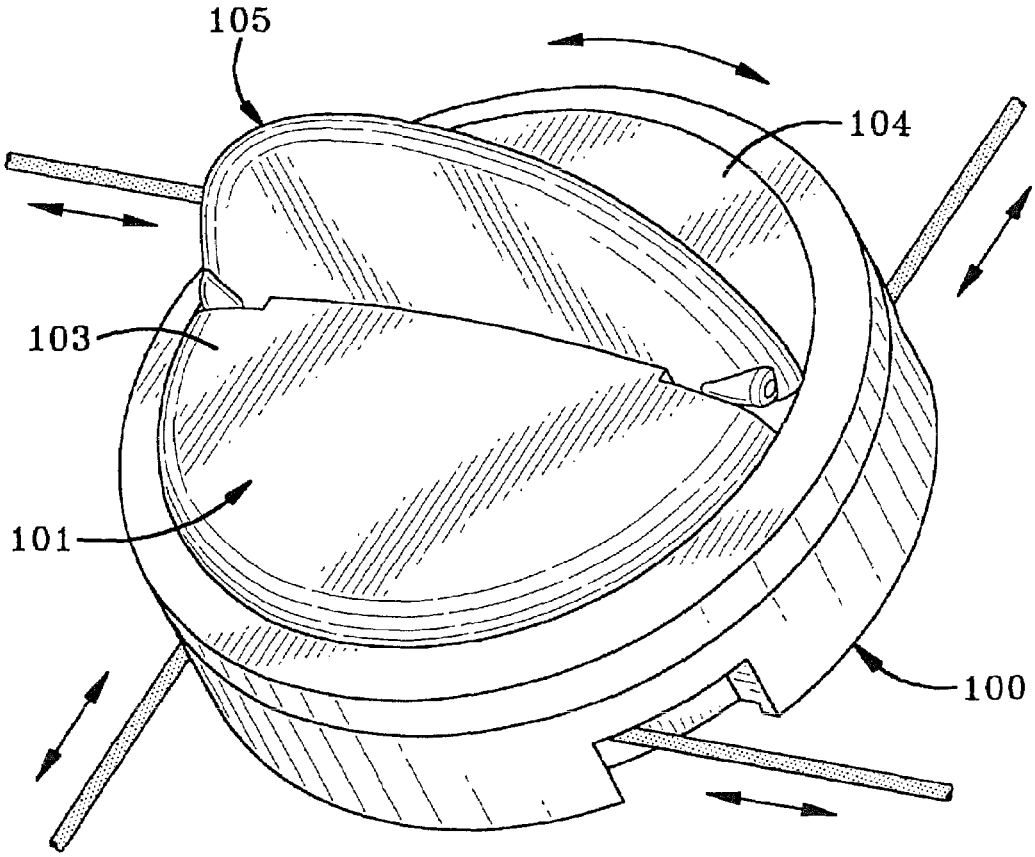
FIG. 16 is a perspective view similar to FIG. 7 of a modified ratchet mechanism with the flip-up handle in a raised operating position.

FIG. 16 shows a modified ratchet mechanism 100 and is similar to ratchet mechanism 4 discussed above except that it does not contain the alarm system, but provides the mechanical locking and unlocking features thereof discussed above and further below. Top wall portion 101 of mechanism 100 preferably includes a semi dome-shaped portion 103 and a semicircular flat portion 104 against which flip-up handle 105 will rest when in a down position (not shown), similar to that discussed above and shown in FIG. 7.

In accordance with another feature of the invention best illustrated in FIGS. 14 and 15, locking member 5, and in particular base 7 thereof, will be formed with a configured end 107 (FIGS. 3 and 4), which is complimentary to a portion of a recess 108 formed in pawl release plate 37. This enables base 7 to rotate plate 37 from a locked position of FIG. 14 to the unlocked position of FIG. 15. In the locked position of FIG. 14, locking teeth 76 of locking pawls 74 are engaged with ratchet teeth 32 of housing 27 to prevent movement of spool 40 toward an unlocked position, in which position cables 16 can be loosened and removed from package 2. Using a portion of locking member 5 as an unlocking key to place the spool in a free wheeling position eliminates the need for a separate key or mechanism.

The operation of the improved security device is as follows. The device is installed on package 2 by wrapping cable loops 15 and 17 around the package as shown in FIGS. 1 and 2, such that locking member 5 preferably lies on one of the major panels of the package and ratchet mechanism 4 lies on an opposite major panel of the package. Fastener 8 is slidably inserted into base 7 where metal tines automatically snap into locked position against shoulders 21. Handle 85 is then pivoted to the up operating position of FIG. 8 and manually rotated. This rotates top wall portion 57 and correspondingly rotates spool 40 which will wrap the cable about hub 41 until the cables are secured tightly about package 2. Locking teeth 76 of locking pawls 74 automatically engage housing teeth 32 as spool 40 rotates until any excess lengths of cable loops 15 and 17 are wrapped about spool hub 41. The alarm system will be automatically actuated and the sensing loops through cable loops 15 and 17 will be operational due to the contact of enlarged metallic ends 49 with the circuit board 46.

An EAS tag 110 preferably is located within internal chamber 9 of base 7 and will provide the additional security of actuating a secured gate alarm, such as at the exit of a retail store, should an unauthorized person attempt to remove a protected package having security device 1 still wrapped thereabout from the store.

To remove security device 1 from package 2 as at a checkout counter of a retail establishment, magnetic key 23 is placed in the correct position on locking member 5 by use of alignment projections 25 to move tines 12 to the unlocked position as shown in FIG. 4, enabling fastener 8 to be slid from within base 7. The cable loops can then be removed easily from around the package which is then given to a customer after payment, for removal from the retail establishment.

In accordance with another feature of the invention, device 1 is useable on various size packages. Depending upon the size of package 2 from which security device 1 is removed, it can be placed easily around a larger package by placing spool 40 in a free wheeling position. This enables the cable to be unwound easily by rotating spool 40 in an unlocking direction. This is achieved by placement of configured end 107 of locking base 7 in recess 108 of pawl release plate 37 and rotating it from the locked position of FIG. 14 in a counterclockwise direction as shown by Arrow A, to the unlocked position of FIG. 15. This rotational movement will rotate locking disc 68 due to its connection by screws 69 to plate 37, which will cause camming projections 73 of gear disc 75 to move along a surface of camming slots 71. Slots 71 are configured whereby the position of projections 73 will move radially inwardly as they move along slot surfaces 72, moving with them the distal ends of locking pawls 74 radially inwardly which will disengage gear teeth 76 from housing gear teeth 32. This enables spool 40 to rotate freely, enabling the cables to be pulled very easily to a longer length. This is accomplished without the use of a key or other mechanism separate from the security device to disengage the locking pawls from the housing gear teeth. Once the desired length of cable has been pulled outwardly from ratchet mechanism 4 by the free wheeling effect of spool 40, pawl release plate 37 is moved again from the unlocked position of FIG. 15 to the locked position of FIG. 14, by the use of the configured end 107 of locking member base 7. A hollow boss 113 (FIGS. 10, 12 and 13), which is formed on gear disc 75, extends through a curved opening 115 formed in pawl release plate 37, to limit the rotational movement of plate 37 when moving between the locked position of FIG. 14 and the unlocked, free wheeling position of FIG. 15. A plunger switch 117 (FIG. 12) is electrically connected to circuit board 46 and extends into the hollow interior of boss 113 and is used to test the alarm control system after manufacture and by store personnel.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A security device comprising:

a housing having a first plurality of ratchet teeth and containing a rotatably mounted spool and a cable operatively connected to the spool for placement about an object, said spool being rotatable relative to the first plurality of ratchet teeth in a cable-tightening direction to wind the cable onto the spool and rotatable in an opposite cable-loosening direction to unwind the cable from the spool;

a ratchet mechanism connected to the spool including a moveable member operatively connected to the spool and having a second plurality of ratchet teeth for releasable engagement with the first plurality of ratchet teeth to prevent the spool from rotating in the cable-loosening direction, said first and second plurality of ratchet teeth extending about a common axis; and a camming mechanism for moving the first and second plurality of ratchet teeth out of engagement to place the spool in a free wheeling position in which the spool is freely rotatable in the cable-loosening direction.

2. The security device defined in claim 1 including a locking member preventing the camming mechanism from moving the first and second plurality of ratchet teeth out of engagement when in a locked position.

3. The security device defined in claim 1 including a key operatively engageable with the locking member enabling the camming mechanism to disengage the first and second plurality of ratchet teeth placing the spool in the cable-loosening direction.

4. The security device defined in claim 1 wherein the first plurality of locking teeth are fixed to the housing and the moveable member containing the second plurality of locking teeth is a disc; and in which the camming mechanism operatively engages said disc.

5. The security device defined in claim 4 wherein the spool includes a hub and first and second spaced flanges, with said first flange being operatively connected to the disc.

6. The security device defined in claim 1 wherein the housing includes a top wall portion rotatably mounted on a cylindrical sidewall of the housing and operatively connected to the spool; and in which a handle is mounted on the top wall portion for rotating said top wall portion and the spool in the cable-tightening direction by a user manually grasping and manually rotating the handle and top wall portion without requiring the use of a special tool.

7. The security device defined in claim 1 including an alarm system contained in the housing; and in which a sensing loop is formed in the cable and when compromised actuates an audible alarm of the alarm system.

8. The security device defined in claim 7 wherein the alarm system includes a visual indicator indicating that the alarm system is activated.

9. A security device adapted to be placed about an object, said device comprising:

a housing containing a rotatably mounted spool and a cable operatively connected to the spool for placement about the object; said housing including a top wall portion rotatably mounted on the housing and operatively connected to the spool; and a ratchet mechanism connected to the spool, said ratchet mechanism having a handle mounted on the top wall portion of the housing for manual rotation of the top wall portion and spool without the need of a separate tool for tightening the cable around the object, said ratchet mechanism further including a moveable first member having a first plurality of ratchet teeth for latching the spool in a fixed position relative to the housing to maintain the cable tightened around the object, with said first member and the spool extending about a common axis.

10. The security device defined in claim 9 wherein the housing includes a second plurality of ratchet teeth and the spool includes the first plurality of ratchet teeth operatively connected thereto; and in which said first and second plurality of ratchet teeth are releasably engageable to prevent the spool from rotating in a cable-loosening direction.

11. The security device defined in claim 10 including a camming mechanism for moving the first and second plurality of ratchet teeth out of engagement to place the spool in the cable-loosening direction.

12. The security device defined in claim 11 wherein the camming mechanism slidably engages the first member to latch the spool in the fixed position relative to the housing.

13. The security device defined in claim 11 wherein the camming mechanism includes at least one pin projecting from the first member and a second member having a curved surface slidably engaged by said at least one pin for moving the first and second ratchet teeth out of engagement.

14. The security device defined in claim 9 including an alarm system contained in the housing; and in which a sensing loop is formed in the cable and when compromised actuates an audible alarm of the alarm system.

15. The security device defined in claim 14 wherein a plurality of perforations are formed in the rotatable top wall portion of the housing and align with the audible alarm.

16. The security device defined in claim 15 wherein the alarm system includes a visual indicator indicating that the alarm system is activated.

17. The security device defined in claim 16 wherein the visual indicator is an LED; and in which the LED is mounted in the housing and is located adjacent a hole formed in a rotatable top wall portion of the housing.

18. The security device defined in claim 9 wherein an alarm system is contained within the housing and includes an audible alarm, a visual indicator and a sensing loop in the cable, and in which a battery which is mounted in the housing supplies power to said audible alarm, visual indicator and sensing loop.

19. A security device adapted to be placed about an object, said device comprising:

a cable for placement about the object;

a ratchet mechanism connected to the cable, said ratchet mechanism having a handle for manual rotation of an internal spool for tightening the cable around the object;

a locking member being connected to the spool and releasably engaged in a locked position for securing said spool in a tightened position;

wherein the ratchet mechanism includes a housing formed with a series of internal ratchet teeth; in which the spool has a plurality of locking teeth operatively connected thereto and releasably engageable with the ratchet teeth of the housing to maintain the cable tightened around the object; and wherein the spool includes a hub and first and second spaced flanges, said first flange having the plurality of the locking teeth formed thereon, and in which the first flange is moveable with respect to the ratchet teeth for moving said locking teeth out of engagement with the ratchet teeth to place the spool in a free wheeling position.

20. The security device of claim 19 wherein the internal ratchet teeth and locking teeth extend about a common axis about which the spool rotates.

* * * * *

UNITED STATES PATENT AND TRADEMARK OFFICE

CERTIFICATE OF CORRECTION

PATENT NO. : 7,481,086 B2
APPLICATION NO. : 11/875090
DATED : January 27, 2009
INVENTOR(S) : Fawcett et al.

It is certified that error appears in the above-identified patent and that said Letters Patent is hereby corrected as shown below:

Column 8, line 28 (Claim 3) "The security device defined in claim 1" should be changed to --The security device defined in claim 2--

Signed and Sealed this
Twenty-first Day of February, 2012

David J. Kappos

David J. Kappos
*Director of the United States Patent and Trademark Office*